US006439410B1

(12) United States Patent
Dubach

(10) Patent No.: US 6,439,410 B1
(45) Date of Patent: Aug. 27, 2002

(54) INTEGRALLY SHAPED PLASTIC CLOSURE

(75) Inventor: Werner Fritz Dubach, Maur (CH)

(73) Assignee: Soplar SA, Altstätten (CH)

( * ) Notice: Subject to any disclaimer, the term of this patent is extended or adjusted under 35 U.S.C. 154(b) by 0 days.

(21) Appl. No.: 09/601,307

(22) PCT Filed: Dec. 18, 1998

(86) PCT No.: PCT/CH98/00545

§ 371 (c)(1),
(2), (4) Date: Jul. 31, 2000

(87) PCT Pub. No.: WO99/38781

PCT Pub. Date: Aug. 5, 1999

(30) Foreign Application Priority Data

Jan. 30, 1998 (CH) ..... 222/98
Jun. 4, 1998 (CH) ..... 1214/98

(51) Int. Cl.[7] ..... B65D 39/00
(52) U.S. Cl. ..... 215/235; 220/836
(58) Field of Search ..... 215/235, 236, 215/224, 237, 239; 220/836–840, 841–848, 810–813; 223/556, 557

(56) References Cited

U.S. PATENT DOCUMENTS 3,135,456 A 6/1964 Palazzolo
5,007,555 A * 4/1991 Beck ..... 220/339
5,423,442 A * 6/1995 Nozawa et al. ..... 215/235
5,558,239 A 9/1996 Dubach
5,642,824 A * 7/1997 Hess, III et al. ..... 215/235

FOREIGN PATENT DOCUMENTS

| | | |
|---|---|---|
| DE | 18 08 875 | 7/1969 |
| DE | 19 60 247 | 6/1970 |
| EP | 0 056 469 | 7/1982 |
| EP | 0 291 457 | 11/1988 |
| EP | 0 640 167 | 5/1997 |

* cited by examiner

*Primary Examiner*—Lee Young
*Assistant Examiner*—Lien Ngo
(74) *Attorney, Agent, or Firm*—Pauley Petersen Kinne & Erickson

(57) ABSTRACT

Plastic snap-on hinged closures each having a bottom part and a cap that are attached to each other by a snap-on hinge tend to tear on the lateral borders. This is due to the geometry of closures having a round or oval shape when viewed from the top since only the flexibility of the outer walls have been used so far. This unresolved problem can be solved by a curvature with varying height and wall thickness extending along the joint. The curvature is elastic when pressure is exerted in the middle and when pulled from the sides.

7 Claims, 3 Drawing Sheets

FIG. 5
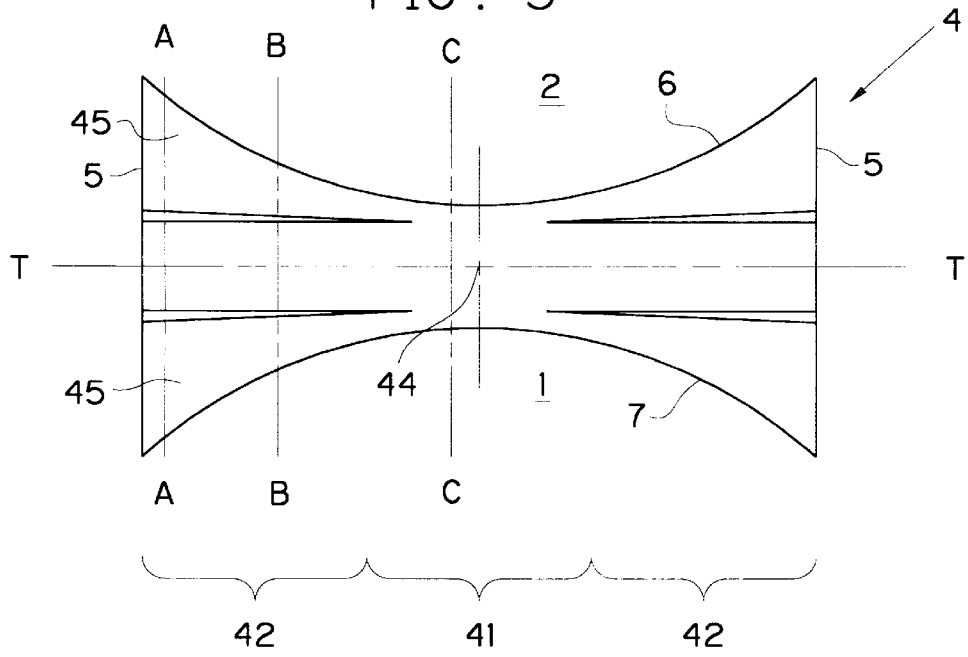
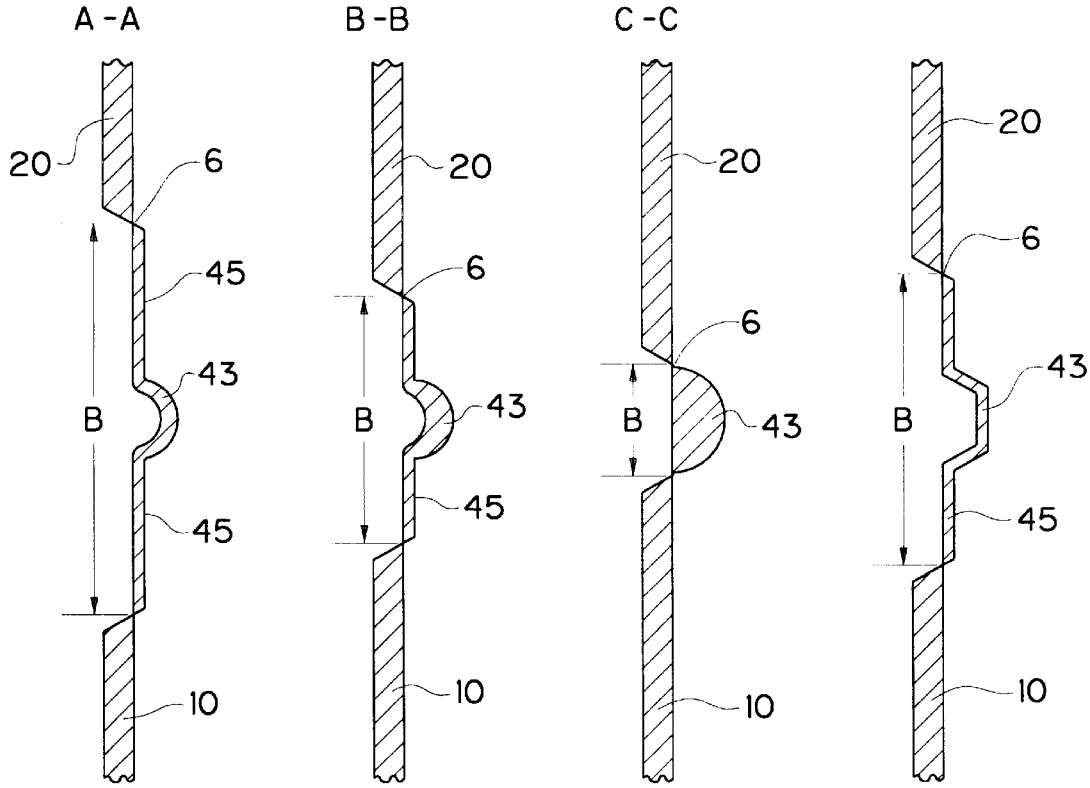
FIG. 6 FIG. 7 FIG. 8 FIG. 9

INTEGRALLY SHAPED PLASTIC CLOSURE

BACKGROUND OF THE INVENTION

1. Field of the Invention

This invention relates to an integrally shaped plastic closure, having a lower element and a cap, which is connected by a hinge, which creates a snap effect. Here, the cap and the lower element of snap closures have curved casing walls, which are preferably shaped as circular or oval cylinders and are located vertically above each other in the closed state. Such plastic closures, which are applied to plastic containers in particular, essentially differ, besides in the design shape, with respect to the embodiment of the hinge creating the snap effect.

2. Description of Related Art

One of the earliest plastic snap closures is disclosed in Palazzolo, U.S. Pat. No. 3,135,456. A closure, having a cap and lower element, as well as a movable element connecting the two elements, can be made in one piece of plastic. In this case the hinge is formed by the movable element, which is delimited with respect to the cap, as well as with respect to the lower element, by a film hinge extending in the shape of an arc. The two arc-shaped film hinges approach each other from the side of the strip-shaped movable element in the direction toward the center, and move apart from there in the direction of the other movable element. Thus, the two arc-shaped film hinges approach each other toward the center, but do not touch each other. Thus a flat movable element remains between the cap and the lower element, which can be moved over two totally separated pivot axes. Thus, two independent tilt movements occur during respectively opening or closing of the closure, which causes a closing movement which cannot be coordinated. During opening, the center of the movable element is compressed because of the casing walls formed as circular or oval cylinders, while the longer, lateral movable surfaces are placed under a relatively large tensile stress. Because the casing walls of the closure are also made of plastic and have elasticity, a deformation of one or both casing walls of the cap, or respectively the lower element, occurs during the respective opening or closing of the closure. This principle disclosed here was only recognized again later and was again realized in various different snap closures.

Such a closure on a container is represented in German Patent Reference DE-A-19 60 247, wherein the casing wall is specially designed for creating this spring effect. This unusual snap hinge technology was in absolute contrast to the system which had been customary up to that time, wherein the closure was formed by a spiral spring element, wherein the spiral spring was either stretched or compressed during opening, because of which there are three hinges. The main hinge is the connection between the cap and the lower element, while the spring element is connected via two film hinges, extending parallel with the main hinge, on the one side to the cap, and on the other side to the lower element. German Patent Reference DE-A-18 08 875 discloses such a film hinge closure. This reference teaches no use of the deformation of the casing walls of the closure.

European Patent Reference EP-A-0 056 469 is in contrast thereto, wherein the principle of the system of U.S. Pat. No. 3,135,456 is taken up again because the curved film hinges only approach each other. European Patent Reference EP-A-0 056 469 discloses the same system, wherein the limiting film hinges run together towards the center into a common main film hinge. Thus a snap hinge is formed having two lateral tensile elements with an approximately triangular shape and oriented toward each other with their tips, and from there continue to run into a common main axis. Since the movable portion between the cap and the lower element is reduced to an absolute minimum, an exact closing movement around the so-called main axis results, but this unavoidably leads to considerably increased forces in the snap hinge. In principle the two lateral triangular stretch elements would be too short, and accordingly the casing walls, which are curved in an arc, need to be relatively strongly deformed. This mode of function is correctly described for the first time in this document.

The tensile elements arranged laterally of the main axis are bordered by film hinges. The increased tensile stresses lead to these film hinges being overextended during the first closing of the closure, and therefore the tensile elements are curved outward in the form of an arc with respect to the casing walls. This was esthetically unsatisfactory and also led to defects again and again, since the overextended film hinges were extremely sensitive to shearing forces. Accordingly, further film hinges were developed which had tensile strips in place of the triangular lateral tensile elements, which were housed in recesses and extended in the shape of an arc in the open state of the closure. These tensioning strips made a transition directly into respectively the cap or the lower element without film hinges. Accordingly, there were no film hinges which could be overextended, and even after multiple uses the tensioning strips remained extending practically in the plane of the casing walls. However, the principle of the elastic deformation of the casing walls during opening and closing of the closure was employed here, too. This system is known from European Patent Reference EP-A-0 291 457.

Finally, a solution has become known from European Patent Reference EP-A-0 640 167, which again returns to the old system taught by U.S. Pat. No. 3,135,456 wherein the two pivot hinge axes, formed by the so-called "curved lines" and extending at a distance from each other, lead to a closure, whose closing movement takes place in a manner not rationally foreseeable. An element controlling the closing movement was attached in the area between these two film hinges. This is a so-called tilt element with two defined contact surfaces which, in a defined movement, initially rest against the lower element, whereupon a first pivot movement around a first pivot axis takes place, after which the second pivot movement then takes place between the support element and the cap. The same takes place in the reverse order when opening the closure. Although the support element described here leads to an improved sequence of movements, it does stiffen the closure in exactly the critical area of the casing walls which must be absolutely deformable. The tensile stresses on the lateral tensile elements are again increased by this. This has the positive result of an increased snap effect and the negative result that the lateral tensile elements also often tear in the area where they are connected respectively to the lower element or the cap. Tears were also discovered along the reinforced tilt element.

A snap hinge in accordance with U.S. Pat. No. 3,135,456 has recently become known from U.S. Pat. No. 5,642,824. In a change of the variation in accordance with European Patent Reference EP-A-0 640 167, the turn-out movement of the intermediate element between the two arc-shaped film hinges is realized by a bulging contact surface on the lower closure element. Thus it is achieved that the intermediate element, which is inwardly arched in the open state, rests on the bulging contact surface during closing. This same functional effect leads to the same tear formation in the central area at both film hinges.

SUMMARY OF THE INVENTION

Again based on U.S. Pat. No. 3,135,456, and taking into consideration the prior art acknowledged here, it is one object of this invention to create a plastic snap hinge closure such as is known from U.S. Pat. No. 3,135,456, which is no longer overextended in the transition area between respectively the movable portion of the cap or the lower element, and accordingly no longer tends to tear.

This object is attained by means of an integrally shaped plastic closure with the following specification and claims.

Due to the design of the plastic closure proposed here, the snap effect is no longer achieved by means of the deformation of the casing walls alone, such as in connection with the embodiments in accordance with U.S. Pat. No. 3,135,456 and European Patent Reference EP-A-0 056 469, for example, but also not only by means of the classic spiral springs such as disclosed, for example, in German Patent Reference DE-A-18 08 875, instead, a symbiosis of these two systems is here disclosed for the first time.

BRIEF DESCRIPTION OF THE DRAWINGS

This invention will now be explained by the attached drawings and the following description wherein:

FIG. 5 shows the inside of the freely movable hinge element on an enlarged scale;

FIG. 6 shows a section along the line A—A of FIG. 5;

FIG. 7 shows a vertical section along the line B—B of FIG. 5;

FIG. 8 shows a vertical section along the line C—C of FIG. 5;

FIG. 9 shows an alternative embodiment of the cross-sectional shape of the movable hinge element in approximately the area of the section line A—A;

DESCRIPTION OF PREFERRED EMBODIMENTS

Figure 1:
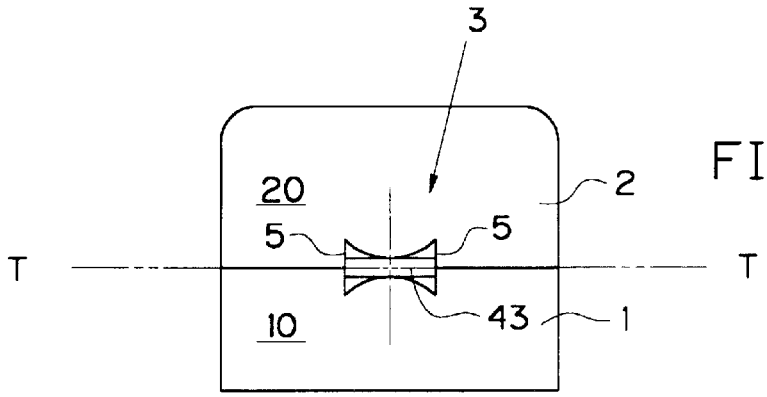
FIG. 1 is a side view of a plastic closure in the unmounted, closed state with a front view on the snap hinge.

The integrally shaped plastic closures discussed are understood to be plastic closures which have two parts and are embodied in one piece via a so-called snap hinge. The integrally shaped plastic closure represented has a lower element 1 and an upper element 2, which may also be called lid or cap in what follows. The two elements 1 and 2 are connected in one piece and hingedly movable with respect to each other. It is essential in connection with the snap hinges produced here, that the cap 2 and the lower element 1 have casing walls, which extend curved and are located vertically above each other, at least in the area of the hinge 3. These casing walls are customarily designed circular-cylindrically or oval-cylindrically. With casing walls extending absolutely in a straight line, snap hinge closures can be easily produced and are therefore not a subject of this invention.

The actual snap hinge 3 has a continuous one-piece movable element 4, which is represented specially by itself in FIG. 5. The movable element 4 is bordered on both sides by lateral edges 5. Toward the top, the movable element 4 is bordered in a pivotally movable manner in the direction toward the cap 2 by a film hinge 6, which extends in a curve. A film hinge 7, which is curved in at least approximately the same way, extends mirror-symmetrically with respect to the plane of separation T and represents the border between the movable element 4 and the bottom element 1. The lateral edges 5 are freely movable. However, a corresponding recess 8 is advantageously provided in the lower element 1, and in the upper element or respectively the cap 2 a corresponding recess 9, so that in the closed state of the closure the greater portion of the movable element 4 lies inside the circumferential contour of the closure.

The entire movable element 4 has the appearance of a butterfly as a whole. The longitudinal extension direction of the hinge 3 is understood to be the longitudinal extension in the same direction in which the plane of separation extends. Seen as a butterfly, the movable hinge element 4 therefore has a longitudinal extension over both "wings" from one lateral edge 5 to the other lateral edge 5. Although the movable element 4 as a whole is only a single element, it has functionally different areas. A clearly visible zone is present, the pressure zone 41, on which primarily pressure forces act during the opening and closing of the closure, and two laterally adjoining areas, the so-called tensile zones 42, can be detected, on which tensile forces primarily act during the opening and closing of the closure. Since these zones are not physically delimited, no clear border lines are consequently drawn. However, this division is made use of and the movable element 4 is correspondingly designed in such a way that the functionally different areas 41, 42 are also differently designed. Thus the movable element 4, for example, has a bulge 43 extending on the exterior continuously from one lateral edge 5, to the other lateral edge 5, the shape of which can be designed differently. In a preferred embodiment the bulge 43 is designed as a semi-cylindrical bead. However, the bulge 43 can also have a more rectangular or trapeze-like cross section. This design of the cross section is essentially unimportant for this invention. However, the change in the thickness of the material and/or the camber are of importance. The thickness of the material decreases from the center 44, which is located approximately in the center of the pressure zone 41, toward the outside and the two lateral edges 5. The same effect is achieved by the camber of the bulge 43 increasing toward the edges 5, so that greater stretching can take place there. This reduction of the thickness of the material preferably takes place successively. No sharp transitions between pressure and tensile areas can be detected. At the point where the bulge 43 crosses the center 44 of the movable element 4, the thickness of the material is preferably equal to the entire cross-sectional surface of the bulge 43. Further thickening, so that the material projects inward toward the center of the closure, is undesirable. For example, it can be seen in FIGS. 6, 7 and 8 how the thickness of the material of the bulge 43 is successively reduced from the center 44 toward the outer edges 5. FIG. 8, representing a section along the line C—C in FIG. 5 shows that in this area the bulge 43 is designed as a filled, but relatively flat bead. This bead now becomes taller, but is reduced in the thickness of the material, from the center further outward toward the lateral edges 5 in that the bead is more and more hollowed out from the inside. In the outer area, i.e. at the point where the section line A—A is drawn, the thickness of the material of the bead is no longer greater with respect to the adjoining area. This means that the bulge 43 extends in the manner of a relatively thin-walled spiral spring. Accordingly, the bulge 43 is now designed in the area of the pressure zone 41 in such a way, that the pressure forces occurring here compress the zone like a spiral spring, but practically no longer result in a deformation of the respective adjoining casing walls 10 or 20 of respectively the lower element 1 or the cap 2. But in the tensile zones 42 the bulge 43 becomes so thin in the direction toward the closest lateral wall, that under the occurring tensile forces the bulge 43 can be stretched like an extension spring. This ability of the "wings" to stretch permits a considerable enlargement of the movable hinge element 4 of the closure. This has an advantage, because the closure is considerably more stable against torsional forces, which can occur when turning the lower element 1 and the cap 2 with respect to each other. These torsional forces occur relatively often in the course of using a snap hinge closure attached to a container.

Up to now, this stretching, or respectively the design of the size of the movable hinge element, has been a practically unsolvable optimization task. If it was intended to achieve a strong snap effect, the movable element had to be designed as large as possible, but in that case too large forces appeared in the course of opening and closing the closure, which either excessively deformed the container walls, or caused the tearing of the movable element in the area of the film hinges 6, 7. If the size of the movable element 4 was reduced, the snap effect was also reduced and in the open state the closure rapidly caused twisting of the two closure elements, namely the lower element 2 and the cap 1, with respect to each other during opening and closing, which again led to the destruction of the closure. For the first time this invention makes possible a snap hinge closure with a movable element 4 designed with practically any size.

The outer contour of the bulge 43 is preferably designed so that the bulge 43 appears approximately the same over its entire length. This is essentially a question of esthetics. Regarding dimensioning, there is practically only one limiting size, which is the distance between the two film hinges 6 and 7 extending curved in the approximate area of the center. The minimum distance occurring here corresponds simultaneously to the maximum width of the bulge 43. However, with the particular design of the movable element 4 with the bulge 43, this width B can also be selected to be larger than was considered sensible up to now in connection with the functionality of the closure. If this is compared with a prior art closure in particular, it can be seen that the pressure zone area of the bulge 43 of this invention, in spite of a relatively large distance, that the lower element 1 and the cap 2 perform a precise closing movement.

Contrary to the prior art, the "wing surfaces" 45 of this invention, which are also often called intermediate elements, do not have any relevant elastic deformability which can be used for the snap effect. The tensile-elastic stretchability of the movable element in the outer area of the intermediate element 45 is only based on the bulge 43 which, because of its hollow design, acts as an extension spring.

Figure 2:
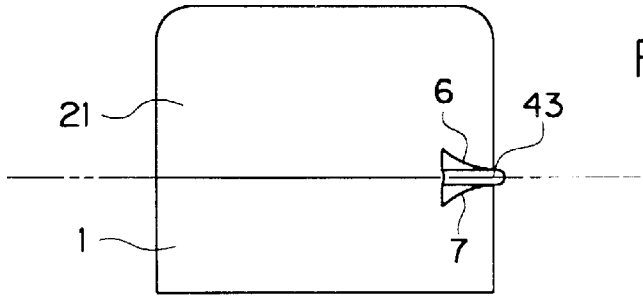
FIG. 2 shows the same closure of FIG. 1 but in a position turned by 90°, so that only half the hinge can be seen.
Figure 3:
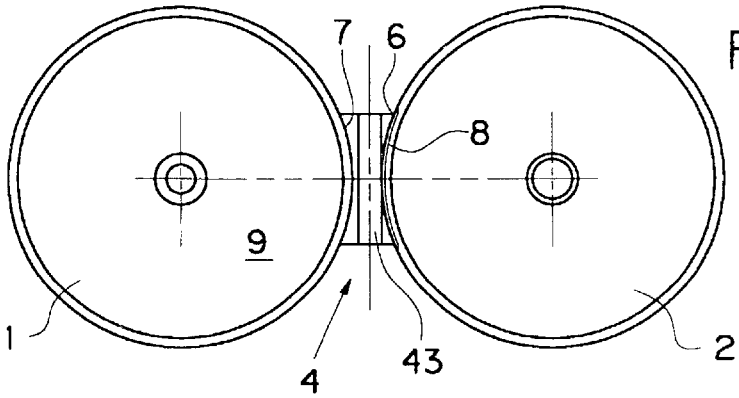
FIG. 3 shows a top view of the closure in accordance with FIGS. 1 and 2, in the open state, wherein the inner surface of the snap hinge is visible.
Figure 4:
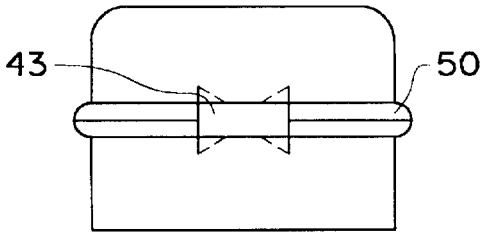
FIG. 4 shows a side view of a design variation of the closure in accordance with this invention, in the closed position as in FIG. 1.

While the embodiment in accordance with FIGS. 1, 2 and 3 shows a closure of customary design, a closure is represented in FIG. 4, which displays a circumferential thickening 50 as an esthetic decorative element. With such a closure the bulge 43 can be dimensioned and designed so that it practically makes a transition into the contour of this circumferential annular bulge 50. The film hinges 6 and 7 will preferably be placed in such a way that they are only visible on the inside. If this is taken into consideration, a closure such as represented in FIG. 4 results.

In the above described and represented embodiments, this invention is essentially described and explained on the basis of the physical design. However, this invention can basically also be described by means of functional characteristics. In principle, the movable element 4 is intended to contain two different functional areas, the centrally located pressure area and the tensile areas adjoining it. By means of an appropriate arched design, or a respective change in the thickness of the material of these areas, these can have a greater or lesser stiffness and can be more or less deformed by tension or pressure. A design as shown by the section along the line B—B is relatively stiff, but can relatively easily be elastically deformed under pressure because of the low bulge, while the elastic tensile deformation is hardly noticeable. Thus, such a shape can be provided evenly over the entire central area.

However, the design must be rather thin-walled for a tensile-elastic deformation, and the bulge relatively larger, so that a lengthening becomes possible.

It can be seen from these rather basic considerations, that a functionally usable snap hinge can also be achieved if the bulge is completely relocated to the inside, instead of the outside.

Figure 10:
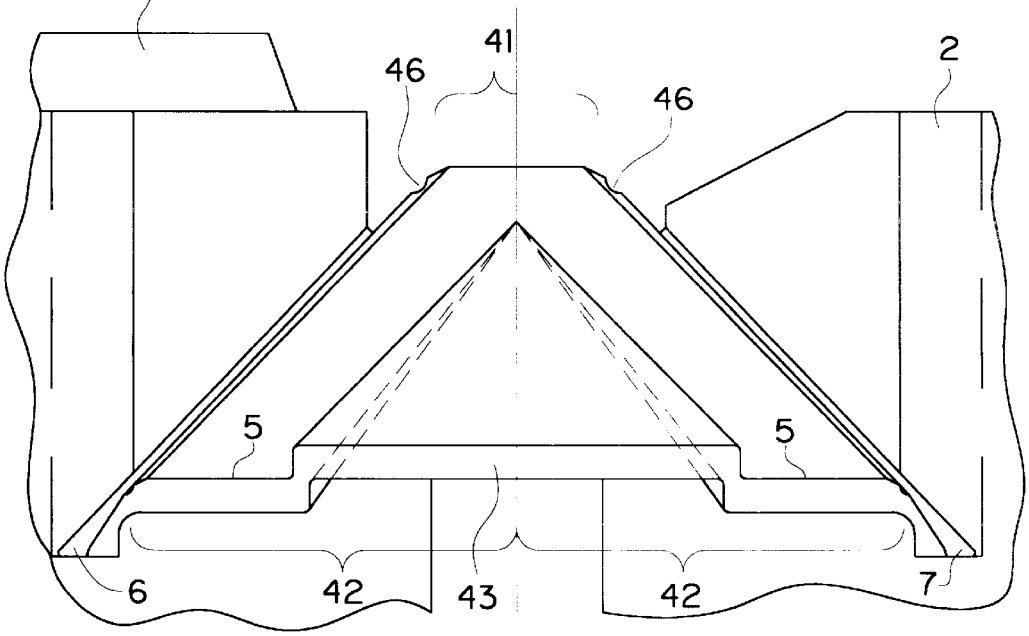
FIG. 10 shows in detail a further embodiment of the cross-sectional shape of the movable hinge element, in a plan view parallel with respect to the section area A—A in the same way as in FIG. 5.
Figure 11:
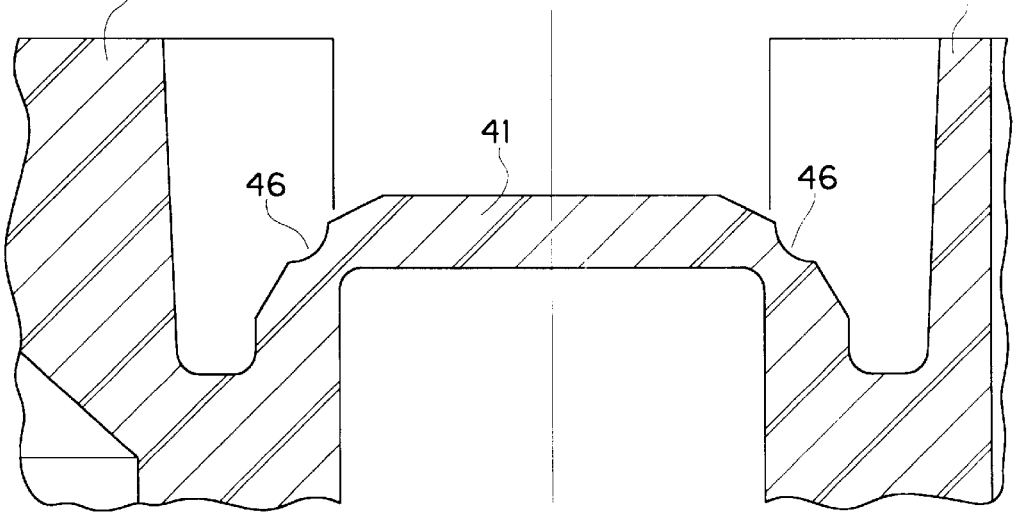
FIG. 11 shows a variation in accordance with FIG. 10 in section area C—C in the same way as in FIG. 5.

Thus this is achieved with the embodiment in accordance with FIGS. 10 and 11. Moreover, in this embodiment the thickness of the respective material or wall of the intermediate element is maintained practically the same over the entire extent from one lateral edge 5 to the opposite lateral edge 5. Only the height of the inward projecting bulge 43' is reduced in the direction toward the pressure zone 41, so that no bulge exists in the area in which the film hinges 6 and 7 are closest to each other. This area 41 forms a compressible leaf spring, which is flexibly and elastically deformed under pressure. However, flexibility must be maintained in this area, if no tear formation is to appear.

It has been shown that unexpectedly the opening angle of maximally 180°, which per se is desirable, can approximately be achieved without producing a "hard" closing closure tending to cause defects.

Besides the bulge 43', which here extends in steps toward the interior, a bending groove 46, which puts the film hinges into a more concrete form, is cut into the film hinges. The bending groove 46 makes the opening and closing movements smoother and more flexible.

The selection of the height of the bulge is essentially a function of the size of the closure and of the wrap angle of the two "wings" around the closure. The selection of the thickness of the material or the wall thickness of the "wings" is the same and of the same function. The selection of the material of course plays a role here. However, this optimization can be performed by the designer on the basis of knowledge of those skilled in the art.

What is claimed is:

1. An integral plastic closure comprising:

a lower element (1), a cap (2);

a continuous one-piece movable element (4) having opposing outer edges (5) and an axis centrally positioned between the outer edges (5);

a continuous first film hinge (7) connecting the movable element (4) to the lower element (1), the first film hinge (7) extending along a first border between the lower element (1) and the movable element (4);

a continuous second film hinge (6) connecting the movable element (4) to the cap (2), the second film hinge (6) extending along a second border between the cap (2) and the movable element (4);

the first border positioned closest to the second border near the axis of the movable element (4), the first border and the second border diverging from each other along an outward direction from the axis to each of the outer edges (5); and the movable element (4) having a bulge portion (43) extending between the outer edges (5) and between the first film hinge (7) and the second film hinge (6), a thickness of the bulge portion (43) decreasing in the outward direction, and the bulge portion (43) becoming more hollowed in the outward direction.

2. In the plastic closure in accordance with claim 1, wherein the movable element (4) is formed by a pressure zone (41) and two tensile zones (42), and the pressure zone (41) is positioned about the axis and between the two tensile zones (42).

3. In the plastic closure in accordance with claim 2, wherein the bulge portion (43) forms a camber, and the camber increases in the outward direction.

4. In the plastic closure in accordance with claim 1, wherein the thickness of the bulge portion (43) decreases in a step fashion.

5. In the plastic closure in accordance with claim 1, wherein the thickness of the bulge portion (43) decreases continuously.

6. In the plastic closure in accordance with claim 1, wherein an outer contour of the bulge portion (43) is curved.

7. In the plastic closure in accordance with claim 1, wherein an outer contour of the bulge portion (43) is rectangular.

* * * * *